US010351384B2

(12) United States Patent
Gohda et al.

(10) Patent No.: US 10,351,384 B2
(45) Date of Patent: Jul. 16, 2019

(54) BOBBIN AND BOBBINLESS TRANSPORT METHOD

(71) Applicants: TOKYO ROPE MANUFACTURING CO., LTD., Chuo-ku, Tokyo (JP); GOHDA INDUSTRIAL CO., LTD., Higashi-osaka, Osaka (JP)

(72) Inventors: Mitsugu Gohda, Higashi-osaka (JP); Toru Tanaka, Tokyo (JP)

(73) Assignees: TOKYO ROPE MANUFACTURING CO., LTD., Tokyo (JP); GOHDA INDUSTRIAL CO., LTD., Osaka (JP)

( * ) Notice: Subject to any disclaimer, the term of this patent is extended or adjusted under 35 U.S.C. 154(b) by 24 days.

(21) Appl. No.: 15/553,265

(22) PCT Filed: Feb. 18, 2016

(86) PCT No.: PCT/JP2016/054652
§ 371 (c)(1),
(2) Date: Oct. 26, 2017

(87) PCT Pub. No.: WO2016/136570
PCT Pub. Date: Sep. 1, 2016

(65) Prior Publication Data

US 2018/0297810 A1 Oct. 18, 2018

(30) Foreign Application Priority Data

Feb. 25, 2015 (JP) ..... 2015-035205

(51) Int. Cl.
*B65H 54/58* (2006.01)
*B65H 75/14* (2006.01)
(Continued)

(52) U.S. Cl.
CPC ..... *B65H 75/22* (2013.01); *B65H 54/58* (2013.01); *B65H 75/14* (2013.01); *B65H 75/242* (2013.01)

(58) Field of Classification Search
CPC ..... B65H 75/22; B65H 75/242; B65H 75/14; B65H 54/58; B65H 75/24
See application file for complete search history.

(56) References Cited

U.S. PATENT DOCUMENTS 4,307,854 A 12/1981 Schmidt et al.
5,465,922 A * 11/1995 Vander Groef ..... B65H 54/58 242/573

(Continued)

FOREIGN PATENT DOCUMENTS

CN 200969254 Y 10/2007
CN 203582181 U 5/2014

(Continued)

OTHER PUBLICATIONS

Machine Translation of CN 200969254 Y, Oct. 31, 2007. (Year: 2007).*

(Continued)

*Primary Examiner* — William E Dondero
(74) *Attorney, Agent, or Firm* — Dickinson Wright PLLC

(57) ABSTRACT

A linear body that may be smoothly removed from a bobbin. The bobbin includes a guide tube, a pair of flanges provided on the ends of the guide tube, and a winding drum sandwiched between the pair of flanges. One flange is removably attached to one end of the guide tube and the other flange is fixedly secured to the other end of said guide tube. The winding drum includes a plurality of split drum plates separated by a plurality of slits. A biasing mechanism for biasing each split drum plate inwardly is provided. When the detachable flange has been attached, the split drum plates are supported at both ends from the inner side thereof by (Continued)

supporting projections on the inner surface of each of the flanges. When the detachable flange is removed, the split drum plates move inwardly owing to the respective biasing mechanisms.

5 Claims, 5 Drawing Sheets

(51) Int. Cl.
*B65H 75/22* (2006.01)
*B65H 75/24* (2006.01)

(56) References Cited

U.S. PATENT DOCUMENTS

| | | | | |
|---|---|---|---|---|
| 5,772,151 | A * | 6/1998 | Teng | B65H 54/58 242/573 |
| 2013/0200202 | A1 * | 8/2013 | Jeddore | B65H 75/22 242/597.4 |

FOREIGN PATENT DOCUMENTS

| | | | |
|---|---|---|---|
| JP | 4949381 | | 4/1974 |
| JP | S4949381 | S | 4/1974 |
| JP | 59169622 | A | 9/1984 |
| JP | 628981 | A | 1/1987 |
| JP | 07228423 | A | 8/1995 |
| JP | 08133605 | A | 5/1996 |
| JP | 2008195518 | A | 8/2008 |
| JP | 4269043 | B2 | 5/2009 |
| WO | 0234647 | A1 | 5/2002 |

OTHER PUBLICATIONS

Machine Translation of JP 49-49381, Apr. 30, 1974. (Year: 1974).*
JP Office Action (4 pages) for JP Application Serial No. 2015-035205 and English Language Translation (6 pages), dated Jan. 22, 2019.

* cited by examiner

BOBBIN AND BOBBINLESS TRANSPORT METHOD

CROSS REFERENCE TO RELATED APPLICATIONS

This application is a 35 U.S.C. § 371 national stage application of PCT Application No. PCT/JP2016/054652 filed on Feb. 18, 2016 which claims priority to Japanese Patent Application No. 2015-035205 filed on Feb. 25, 2015, the entire disclosures of the applications being considered part of the disclosure of this application and hereby incorporated by reference.

TECHNICAL FIELD

This invention relates to a bobbin. The invention further relates to a method of transporting solely a linear body, which has been brought together into the shape of a cylinder using a bobbin, without transporting the bobbin. Specifically, the invention relates to a bobbinless transport method.

BACKGROUND OF THE INVENTION

A linear body such as a wire rope, wire or steel cord is manufactured continuously over a long distance along the length thereof. The linear body, therefore, is wound around the body of a bobbin multiple times to bring the body together in compact form.

A linear body such as wire rope, wire or steel cord thus wound on the bobbin is transported together with the bobbin and is used at the destination of transport upon being pulled off the bobbin. The emptied bobbin is then sent back to the source from which it was transported. Since a bobbin used for a wire rope or the like is especially heavy and takes up a comparatively large amount of space, the transport of the bobbin is very costly.

Patent Document 1 describes a bobbin capable of being assembled and disassembled. After a wire material is wound on the bobbin, the bobbin is disassembled. The wire material is shipped and stored in a bobbinless state. The need to send back an emptied bobbin can be eliminated.

PRIOR ART DOCUMENT

Japan Patent No. 4269043

According to Patent Document 1, a core member made of paper is wrapped on a bobbin and a wire material is wound on the paper core member from above. The wire material is removed from the bobbin together with the paper core member. That is, the wire material alone is not removed from the bobbin; the paper core member and the wire material are removed together, transported and stored. The transport and storage of the wire material alone is not achieved in Patent Document 1. Further, even in a case where the wire material is wound on the paper core member and the wire material is removed from the bobbin together with the paper core member, there are also instances where it is difficult to remove the paper core member from the bobbin if the wire material has been wound on the paper core member too strongly.

BRIEF DESCRIPTION OF THE INVENTION

An object of the present invention is to arrange it so that a linear body can be removed from a bobbin smoothly.

A further object of the present invention is to arrange it so that only a linear body that has been brought together in cylindrical form can be transported without using a paper core member of the like. Naturally, the linear body brought together in cylindrical form may be covered with vinyl or the like in order to protect it from external damage, or it may be bundled by bundling members in order to be maintained in the cylindrical state. Transport solely of the linear body does not exclude use of such vinyl or bundling members.

A bobbin according to the present invention comprises: a centrally provided hollow guide tube; a pair of flanges provided on respective ones of both ends of the guide tube, the flanges each having a centrally provided shaft hole communicating with the hollow interior of the guide tube; and a winding drum, which is sandwiched between the pair of flanges, provided on the outer periphery of the guide tube; wherein one flange of the pair of flanges is removably attached to one end of the guide tube and the other flange is fixedly secured to the other end of the guide tube; the winding drum includes a plurality of split drum plates separated by a plurality of slits extending in a direction connecting the pair of flanges, a space being formed between an inner surface of each of the plurality of split drum plates and the outer surface of the guide tube; a biasing mechanism for biasing each split drum plate inwardly is provided between the inner surface of each of the plurality of split drum plates and the outer surface of the guide tube; and both ends of each of the plurality of split drum plates are supported from the inner side thereof by supporting projections provided on the inner surface of each of the pair of flanges.

In this specification, "inward" or "inner" signifies a direction toward the center of the bobbin, and "outward" or "outer" signifies a direction away from the center of the bobbin. The term "outer surface" or "outer side" signifies the surface or side that is on the side opposite the inner surface or inner side.

The bobbin according to the present invention is such that the hollow guide tube and winding drum are arranged, in the order mentioned, outwardly from the center. A space (gap) is formed between the outer surface of the hollow guide tube and the inner surface of the winding drum, the biasing mechanisms being provided in this space. A long linear body, such as, for example, a wire rope, wire or steel cord, is wound on the outer surface of the winding drum. The pair of flanges are provided on respective ones of both ends of the guide tube and winding drum, and the linear body is wound multiple times on the outer surface of the winding drum between the pair of flanges. By winding the linear body on the outer surface of the winding drum multiple times, the linear body is brought together in the shape of a cylinder. Although the number of times the linear body is wound depends upon the diameter of the linear body, it goes without saying that the position of the outer surface of the linear body brought together in the form of a cylinder will not exceed the height of the flanges (the distance from the outer surface of the winding drum to the edge portions of the flanges).

The winding drum includes the plurality of split drum plates separated by multiple slits that extend along the direction connecting the pair of flanges. The plurality of split drum plates preferably have identical dimensions and an identical shape. For example, the winding drum is constituted by six split drum plates, in which case a total of six slits would be formed between mutually adjacent split drum plates. The biasing mechanisms are provided between respective ones of the multiple split drum plates and the guide tube. In the case where the winding drum is constituted by six split drum plates, six biasing mechanisms are provided. The respective split drum plates are biased inwardly by the biasing mechanisms.

One flange of the pair of flanges is detachably provided on one end of the guide tube, and the other is fixedly secured to the other end of the guide tube. Further, the inner surface of each of the pair of flanges is provided with supporting projections for supporting, from the inner side, both ends of each of the plurality of split drum plates. When the detachable flange has been attached to one end of the guide tube, both edges of the split drum plates are supported, from the inner side thereof, by the supporting projections provided on the inner surface of each of the pair of flanges. Even though the split drum plates are biased inwardly by the biasing mechanisms, therefore, the split drum plates will not move inwardly.

When the detachable flange is removed from one end of the guide tube, support of the one end of the split drum plates vanishes. Since the split drum plates are biased inwardly by the biasing mechanisms, the one edge of each of the split drum plates freed of support moves inwardly. Since the outer diameter of the winding drum constituted by the plurality of split drum plates is thus diminished, the linear body that has been wound on the winding drum to thereby be brought together in cylindrical form can be removed from the winding drum smoothly and it is possible to transport solely the linear body removed from the winding drum. Non-wasteful bobbinless transport is achieved.

In a preferred embodiment, support faces of the supporting projections which support both ends of the split drum plates from the inner side thereof are inclined obliquely inward. The entirety of each split drum plate can be moved obliquely inward, namely in the direction toward the center of the bobbin and, moreover, in the direction of the removably attached flange that has been removed, substantially along the inclined support faces of the supporting projections provided on the inner surface of each of the pair of flanges. Further, when the detachable flange that has been temporarily removed is re-attached, the split drum plates that have moved obliquely inward can be restored to their original positions by being moved in the opposite direction, namely obliquely outward, by utilizing the inclined support faces of the supporting projections provided on the inner surface of each of the pair of flanges.

Preferably, it is arranged so that, when the split drum plates have moved obliquely inward, one end of each of the split drum plates (the end supported by the supporting projection of the fixed flange) will not slide down completely from the inclined support face of the supporting projection provided on the inner surface of the fixed flange. This will make it possible to facilitate restoration of the split drum plates to their original positions by being moved obliquely outward when the detachable flange that has been temporarily removed is re-attached.

Preferably, the biasing mechanism includes a tension coil spring. The split drum plate can be biased inwardly by the compression force of the tension coil spring.

Preferably, the biasing mechanisms each include a tension coil spring both ends of which are connected to the split drum plate and guide tube respectively, the split drum plate being moved inwardly and in the direction of the detachable flange, namely obliquely inward, by the compression force of the tension coil spring. This makes it possible to facilitate movement of the entire split drum plate obliquely inward substantially along the inclined support faces of the supporting projections.

In one embodiment, the biasing mechanisms each include a connecting plate connecting the split drum plate and the guide tube, wherein the tension coil spring is provided in such a manner that, when the detachable flange has been removed from one end of the guide tube, the connecting plate will tilt in the direction of the detachable flange that has been removed. The entire split drum plate can be moved obliquely inward with greater accuracy.

In one embodiment, the outer surface of the guide tube is provided with a plurality of stoppers for stopping, en route, obliquely inward movement of respective ones of the split drum plates. The split drum plates move obliquely inward until they strike the stoppers. The obliquely inward movement of the split drum plates can be controlled or suppressed by the stoppers.

Preferably, the outer surface of the guide tube is provided with a plurality of protruding members protruding outwardly, wherein each stopper is secured to the outer surface of the respective protruding member (the surface facing the respective split drum plate) in such a manner that the amount of protrusion of the stopper is adjustable. The inward traveling distance of the split drum plates can be adjusted by adjusting the amount of protrusion of the stoppers.

A linear-body bobbinless transport method according to the present invention comprising: preparing a bobbin having a drum capable of being expanded and retracted along the radial direction thereof, a detachable flange removably provided on one end of the drum, and a fixed flange fixedly secured to the other end of the drum; winding the linear body on the drum in the expanded state to thereby bring the linear body together into a cylindrical shape; removing the detachable flange from one end of the drum; retracting the drum radially inward; removing the cylindrically shaped linear body, which has been wound on the drum, from the drum in the retracted state with the linear body being maintained in cylindrical shape; and transporting the cylindrically shaped linear body that has been removed. Since the outer diameter of the drum is diminished (reduced) owing to retraction of the drum in the radial direction, a gap is formed between the inner surface of the cylindrically shaped linear body wound on the drum and the outer surface of the drum. The cylindrically shaped linear body can be removed from the drum smoothly. Since only the linear body can be transported, non-wasteful bobbinless transport is achieved.

DETAILED DESCRIPTION OF THE INVENTION

Figure 1:
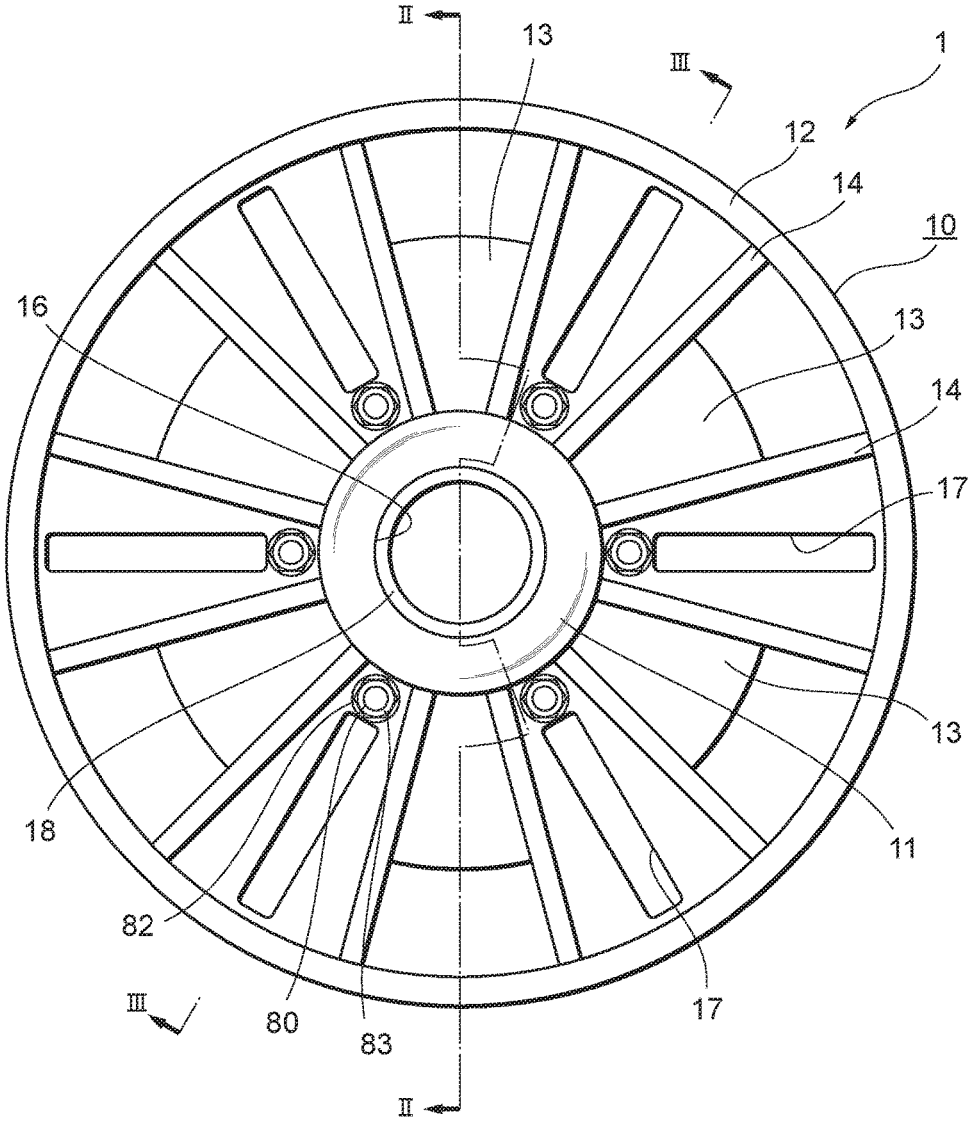
FIG. 1 is a side view of a bobbin.
Figure 2:
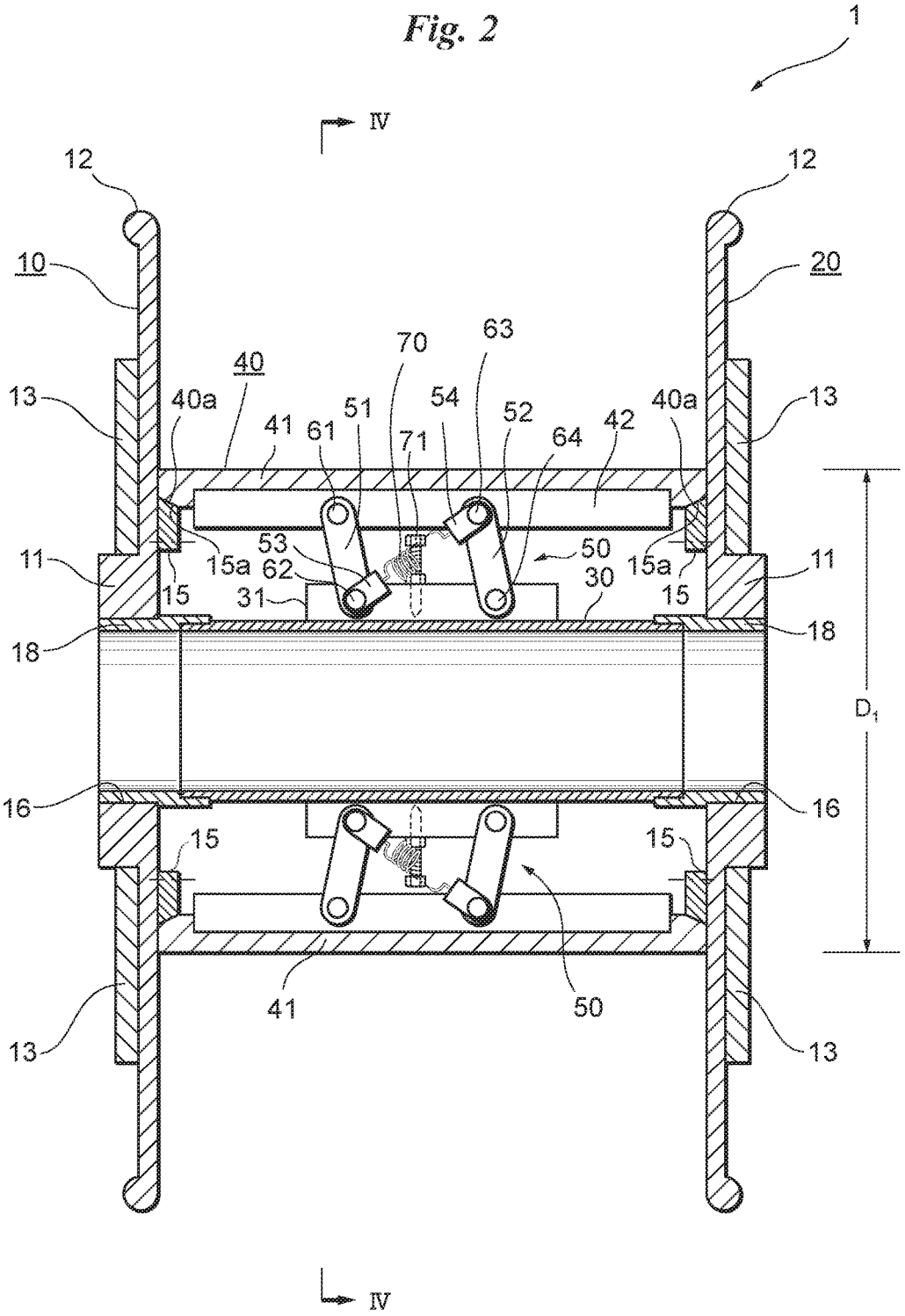
FIG. 2 is a sectional view of the bobbin taken along line II-II of FIG. 1.
Figure 3:
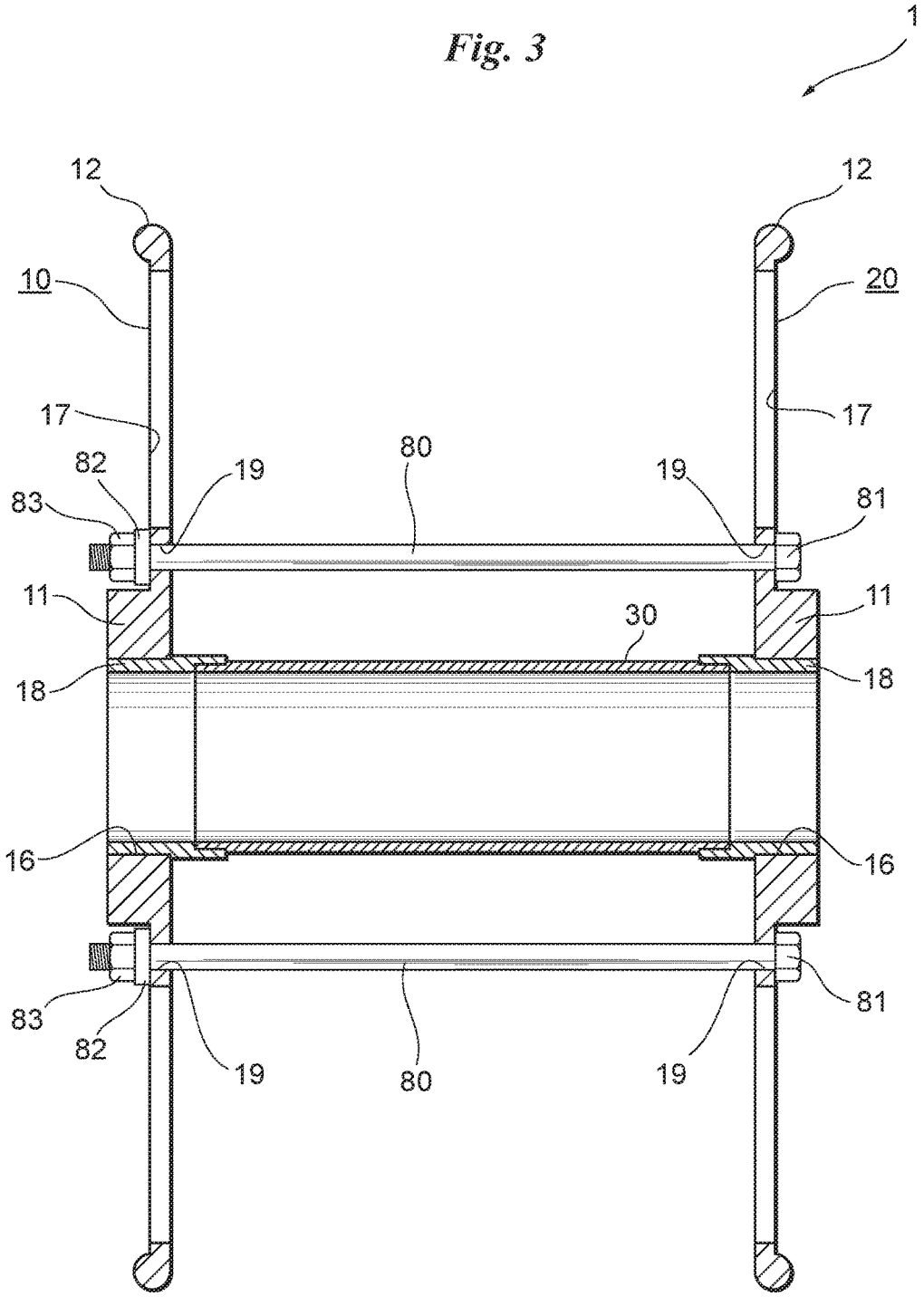
FIG. 3 is a sectional view of the bobbin taken along line of FIG. 1.
Figure 4:
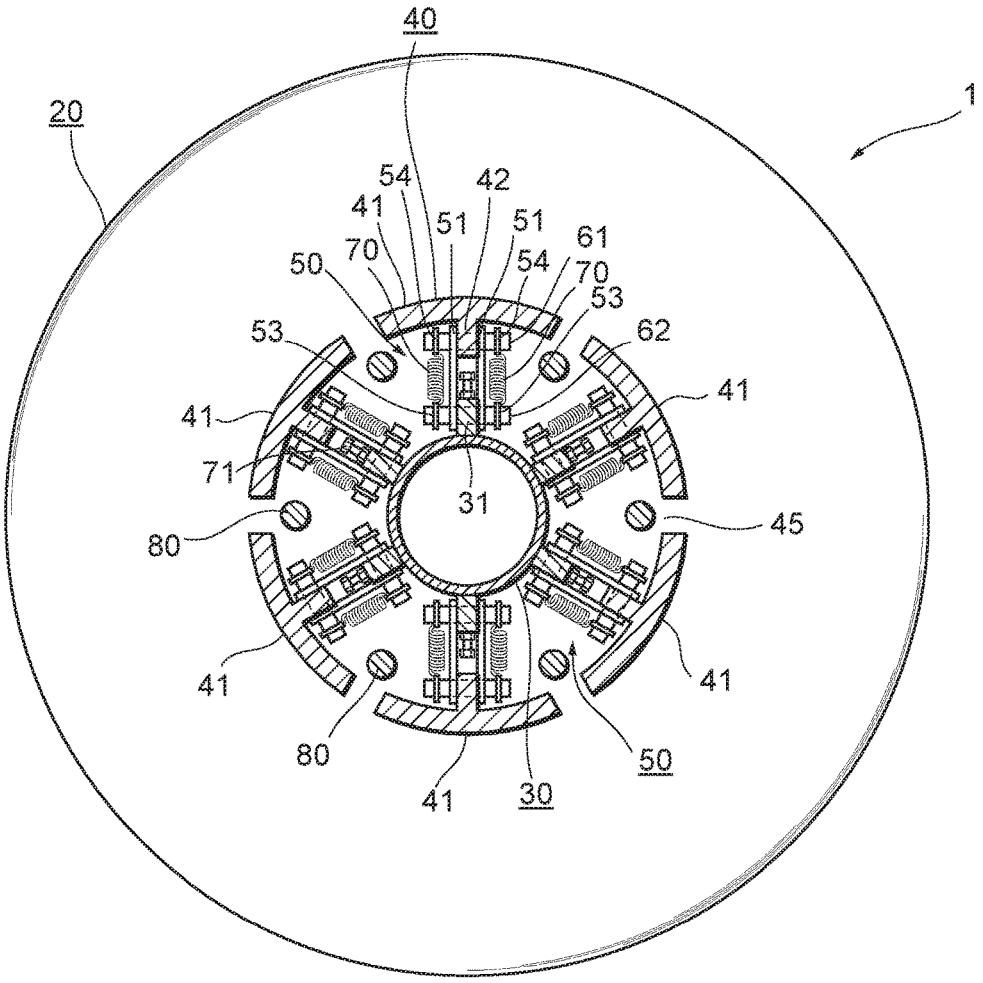
FIG. 4 is a sectional view of the bobbin taken along line IV-IV of FIG. 2.

FIG. 1 is a side view of a bobbin, FIG. 2 a sectional view of the bobbin taken along line II-II of FIG. 1, FIG. 3 a sectional view of the bobbin taken along line of FIG. 1, and FIG. 4 a sectional view of the bobbin taken along line IV-IV of FIG. 2. For the sake of clarity, illustration of ribs 14 and bolts 80, described later, is omitted in FIG. 2. Further, illustration of ribs 14, a winding drum 40 and biasing mechanisms, etc., described later, is omitted in FIG. 3.

The bobbin 1 is used in order to wind a linear body, such as, for example, a wire rope, wire or steel cord, on a winding drum 40 of the bobbin to thereby bring the long linear body together in the shape of a cylinder.

The bobbin 1 has a hollow guide tube (inner cylinder) 30, the winding drum 40, flanges 10, 20 provided on left and right sides, respectively, of the guide tube 30 and winding drum 40, and biasing mechanisms 50. The guide tube 30, winding drum 40 and flanges 10, 20 are made of a hard steel material such as carbon steel. With reference to FIGS. 2 and 4, the guide tube 30 is situated at the center of the bobbin 1 and the winding drum 40 is provided about the outer periphery of the guide tube. With reference to FIG. 4, the winding drum 40 is constituted by six split drum plates 41. The six split drum plates 41 are all identical in shape and dimensions and have an arcuate outer surface and inner surface. The outer surfaces of the six split drum plates 41 are situated on a concentric circle, and the inner surfaces of the six split drum plates 41 also are situated on a concentric circle. A slit (gap) 45 is formed along the longitudinal direction of the winding drum 40 (along the direction connecting the two flanges 10, 20) between mutually adjacent split drum plates 41. In this case where the winding drum 40 is constituted by the six split drum plates 41, six of the slits 45 are formed in the winding drum 40. The number of split drum plates 41 constituting the winding drum 40 is not limited to six. Although the number may be smaller or larger than this, a number on the order of four to eight is practical. A long linear body is wound multiple times on the outer surface of the winding drum 40 (the six split drum plates 41).

With reference to FIGS. 2 and 4, spaces are formed between the guide tube 30 and winding drum 40 (each of the six split drum plates 41). The biasing mechanisms 50 are provided in these spaces.

Although the details will be described later, the winding drum 40 and the flanges 10, 20 on both the right and left sides thereof are not secured to each other, and the winding drum 40 is adapted so as to be capable of being retracted along the radial direction by the biasing mechanisms 50. Once retracted along the radial direction, the winding drum 40 can subsequently be expanded in the radial direction and restored to its original state. Owing to retraction of the winding drum 40 in the radial direction, a gap is formed between the inner peripheral surface of the linear body, which has been brought together in the form of a cylindrical shape by being wound on the winding drum 40, and the outer peripheral surface of the winding drum 40. As a result, the linear body can be smoothly removed from the winding drum 40 while it is maintained in cylindrical form.

Further, although the details will be described later, the two flanges 10, 20 constituting the bobbin 1 have the same structure. However, one flange 10 is removably attached to the guide tube 30 and the other flange 20 is an integral part of the guide tube 30.

With reference to FIGS. 1, 2, 3 and 4, the flanges 10, 20 are disk-shaped and at the center of each is a shaft hole 16 having a circular cross-section. An annular thick portion 11 for reinforcement is provided on the outer surface of each of the flanges 10, 20 about the outer periphery of each shaft hole 16. Cylindrically shaped bearing members 18 are fitted into the respective shaft holes 16 of the flanges 10, 20 and are fixedly secured (by welding, for example). Both ends of the guide tube 30 are fitted into respective ones of the bearing members 18 that have been fitted into respective ones of the shaft holes 16 of the flanges 10, 20, and the outer peripheral surface at both ends of the guide tube 30 and the inner peripheral surface of each of the bearing members 18 are fitted together. The inner peripheral surfaces of the left and right bearing members 18 coincide with the inner peripheral surface of the guide tube 30. The hollow interior of the guide tube 30 is in communication with the shaft holes 16 of the pair of flanges 10, 20.

A columnar shaft (not shown) passes through the guide tube 30 from one bearing member 18 to the other bearing member 18. If the shaft that passes through the left and right bearing members 18 and guide tube 30 is a rotary shaft, the bobbin 1 can be driven rotatively about the guide tube 30 with the rotational motion of the rotary shaft.

The bearing member 18 fitted into the shaft hole 16 of one flange 20 of the two flanges 10, 20 is fixedly secured to the guide tube 30 as by welding. On the other hand, the bearing member 18 fitted into the shaft hole 16 of flange 10 is not fixedly secured to the guide tube 30, the flange 10 being freely detachable from the guide tube 30.

The outer circumferential edge of each of the flanges 10, 20 is curved outwardly and is rounded (the curved portions are indicated at reference numerals 12). Further, 12 radially extending reinforcing ribs 14 are secured at equiangular intervals to the outer surface of each of the flanges 10, 20. The reinforcing ribs 14 protrude outwardly from the outer surface of each of the flange 10, 20. A substantially sector-shaped flange reinforcing plate 13 and an oblong hole 17 are alternatingly provided between two mutually adjacent ribs 14. Specifically, the outer surface of each of the flanges 10, 20 is provided with six flange reinforcing plates 13 at equiangular intervals and with six oblong holes 17 at equiangular intervals.

The oblong holes 17 provided in the flanges 10, 20 connect with the six slits 45 (they are located at the same positions) formed between the six split drum plates 41 that constitute the winding drum 40, and the width of the oblong holes 17 and the width of the slits are equal. The terminus of the oblong hole 17 (the portion thereof near the center of the flange 10) provided in the flange 10 communicates, through the corresponding split 45, with the terminus of the oblong hole 17 (the portion thereof near the center of the flange 20) on the opposite side. A bundling band (not shown) can be inserted from the terminus of the oblong hole 17 provided in the flange 10, passed through the slit 45 and extracted to the exterior from the terminus of the oblong hole 17 provided in the flange 20. The linear body brought together into a cylindrical shape by being wound on the outer peripheral surface of the winding drum 40 can be bundled by the bundling band in a direction perpendicular to the circumferential direction of the cylindrically shaped linear body. Since the flanges 10, 20 are provided with the six oblong holes at equiangular intervals and the winding drum 40 is formed to have the six slits 45, in correspondence with the oblong holes, at equiangular intervals, the linear body brought together in the cylindrical shape can be bundled at equiangular intervals by six of the bundling bands.

With reference to FIG. 2, six supporting projections 15 are secured to the inner surface of each of the flanges 10, 20. In FIG. 2, only four of the six supporting projections 15 secured to the inner surface of each of the flanges 10, 20 can be seen. The supporting projections 15 are attached at equiangular intervals to the inner surface of each of the flanges 10, 20 in correspondence with respective ones of the six split drum plates 41 (see FIG. 4) constituting the winding drum 40.

Each supporting projection 15 has a tapered face (support face) 15*a* having an inwardly slanting incline. A tapered face 40*a* is formed on each of both edges of each of the six split drum plates 41. The tapered faces 15*a* of the supporting projections 15 and the tapered faces 40*a* on both edges of the split drum plates 41 are in contact with each other over their entire surfaces. Each of the six split drum plates 41 constituting the winding drum 40 is supported from its inner side by the supporting projections 15 secured to the inner surface of respective ones of the flanges 10, 20.

With reference to FIGS. 1, 3 and 4, each of the two flanges 10, 20 is further provided at equiangular intervals with six bolt through-holes 19 placed on a concentric circle. Long bolts 80 are passed through respective ones of the six bolt through-holes 19. The six bolt through-holes 19 provided in each of the flanges 10, 20 lie in a direction along the longitudinal direction of the six oblong holes 17 provided in both of the flanges 10, 20, and they are situated inwardly of the oblong holes 17 (namely on the side thereof nearer the flange center).

With reference to FIG. 4, the six bolts 80 are all situated in the space between the guide tube 30 and the winding drum 40 (the six split drum plates 41). Further, the six bolts 80 are all provided at positions that correspond to the slits 45 between mutually adjacent split drum plates 41. When the winding drum 40 (six split drum plates 41) is retracted in the radial direction, that is, when the winding drum 40 moves in a direction in which it approaches the center of the bobbin 1, this motion will not be impeded by the bolts 80.

With reference to FIG. 3, the bolts 80 pass through the bolt through-holes 19 formed in the flange 19 and emerge to the outside through the bolt through-holes 19 of the flange 19 on the opposite side. The distal end of each bolt 80 emerging from the flange 10 is formed to have threads, and a nut 83 is attached to this distal end via a washer 82. Each bolt 80 on the outer side of the flange 20 has a head 81 that is welded to the outer surface of the flange 20, whereby the bolt is fixedly secured.

Figure 5:
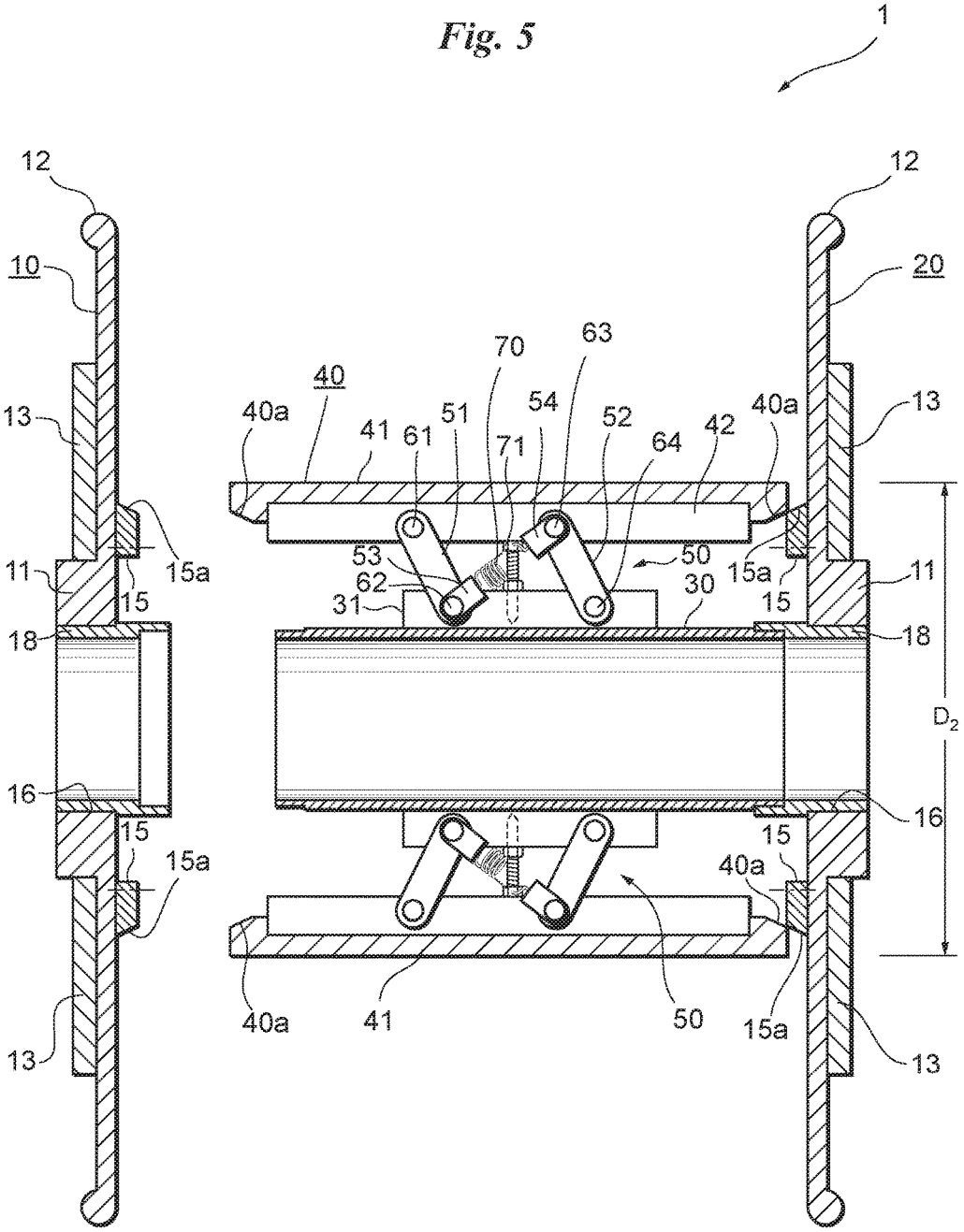
FIG. 5 is a sectional view of the bobbin, which corresponds to FIG. 2, when the removably attached bobbin has been removed.

As mentioned above, the bearing member 18 fitted into and secured in the shaft hole 16 of the flange 20 is fixedly secured to the guide tube 30. Accordingly, the flange 20 and guide tube 30 are integrated. On the other hand, the bearing member 18 fitted into and secured in the shaft hole 16 of the flange 10 is not fixedly secured to the guide tube 30. By removing the nut 83 and washer 82 from the tip of each bolt 80 and subsequently moving the flange 10 in the direction away from the flange 20, the flange 10 can be removed. Since the flange 10 is thus freely attachable and detachable, the flange 10 will be referred to as "detachable flange 10" below. On the other hand, the flange 20 integrated with the guide tube 30 will be referred to as "fixed flange 20" below. FIG. 5 illustrates how the detachable flange 10 appears when it has been removed.

The winding drum 40 is capable of being retracted in the radial direction by the biasing mechanisms 50, as set forth above. The biasing mechanisms 50 will be described below.

With reference to FIGS. 2 and 4, the biasing mechanisms 50 are provided between the cylindrical guide tube 30 and each of the six split drum plates 41 constituting the winding drum 40. Two of the six biasing mechanisms 50 are illustrated in FIG. 2.

Six outwardly projecting plates 31 are secured (as by welding) in outwardly projecting fashion and at equiangular intervals to the outer surface of the cylindrical guide tube 30 situated at the center of the bobbin 1. All of the outwardly projecting plates 31 have a transverse cross-section that is substantially rectangular. The outwardly projecting plates 31 are secured to the guide tube 30 substantially at the middle thereof in terms of its longitudinal direction, the longitudinal direction of the plates is the same as that of the guide tube 30, and the plates have a length that is from one-third to one-half that of the guide tube 30.

Each outwardly projecting plate 31 has two spaced-apart pin through-holes that extend in a direction connecting both side surfaces of the plate, and connecting pins 62, 64 are passed through respective ones of the two pin through-holes tightly so as to be secured.

Six inwardly projecting plates 42 are secured (as by welding) to the inner surface of respective ones of the six split drum plates 41 situated on the outer side of the guide tube 30. The inwardly projecting plates 42 also have a transverse cross-section that is substantially rectangular and project inwardly from substantially the middle of the inner surface of respective ones of the split drum plates 41, which have an arcuate cross-section. The inwardly projecting plates 42 have a longitudinal direction the same as that of the split drum plates 41 and have a length spanning substantially the full length of the split drum plates 41 except for both edge portions of each split drum plate 41 where the tapered faces 40*a* are formed. The split drum plates 41 are also reinforced by the inwardly projecting plates 42.

With reference to FIG. 4, the six inwardly projecting plates 42 projecting inwardly from the inner surface of respective ones of the six split drum plates 41 and the six outwardly projecting plates 31 projecting outwardly from the outer surface of the guide tube 30 are situated on straight lines extending radially outward from the center of the bobbin 1, and gaps are formed between the inwardly projecting plates 42 and outwardly projecting plates 31.

Each inwardly projecting plate 42 also has two spaced-apart pin through-holes that extend in a direction connecting both side surfaces of the plate, and connecting pins 61, 63 are passed through respective ones of the two pin through-holes tightly so as to be secured. The spacing between the two pin-through holes provided in each inwardly projecting plate 42 (the distance between the connecting pin 61 and the connecting pin 63) and the spacing between the two pin-through holes provided in each outward projecting plate 31 (the distance between the connecting pin 62 and the connecting pin 64) are substantially equal. Further, the two pin-through holes formed in inwardly projecting plate 42 are formed slightly closer to the detachable flange 10 than are the two pin-through holes formed in outwardly projecting plate 31.

Connecting plates 51, 52, which are provided with two pin through-holes the diameter of which is slightly larger than that of the connecting pins 61 to 64, are attached to one side face of inwardly projecting plate 42 and one side face of outwardly projecting plate 31. The connecting plate 51 connects the two connecting pins 61, 62 that are near the detachable flange 10. The connecting pin 61, which protrudes slightly from one side face of the inwardly projecting plate 42, is passed through the pin through-hole at one end of the connecting plate 51, and the connecting pin 62, which protrudes slightly from one side face of the outwardly projecting plate 31 is passed through the pin through-hole at the other end of the connecting plate 51. Similarly, the connecting plate 52 connects the two connecting pins 63, 64 that are near the fixed flange 20. The connecting pin 63 is passed through the pin through-hole at one end of the connecting plate 52, and the connecting pin 64 is passed through the pin through-hole at the other end of the connecting plate 52. The connecting plate 51 is provided at an inclined angle in such a manner that the end thereof through which the connecting pin 61 has been passed will be situated closer to the detachable flange 10 than the other end through which the connecting pin 62 has been passed. The connecting plate 52 also is provided at an inclined angle in such a manner that the end thereof through which the connecting pin 63 has been passed will be situated closer to the detachable flange 10 than the other end through which the connecting pin 64 has been passed.

Furthermore, a connecting plate 53 provided with one pin through-hole is mounted on the connecting pin 62 that is near the detachable flange 10 and that protrudes slightly from one side face of the outwardly projecting plate 31. Furthermore, a connecting plate 54 provided with one pin through-hole is mounted on the connecting pin 63 that is near the fixed flange 20 and that protrudes slightly from one side face of the inwardly projecting plate 42. Both ends of a tension coil spring 70 are attached to respective ones of the connecting plates 53, 54.

The connecting plates 51, 52, 53, 54 and the tension coil spring 70 are similarly provided on the other side face of the outwardly projecting plate 31 and inwardly projecting plate 42.

A force having a direction that acts to make the connecting pins 62 and 63 approach each other is produced by the tension coil spring 70. As described above, however, the split drum plate 41 is supported on both sides from the inner side thereof by the supporting projections 15 secured to the inner surface of respective ones of the detachable flange 10 and fixed flange 20. With the detachable flange 10 attached (FIGS. 2 and 4), therefore, the connecting pins 62 and 63 will not approach each other.

The detachable flange 10 can be removed, as mentioned above. With reference to FIG. 5, when the detachable flange 10 is removed, this eliminates support, from the inner side, of each of the split drum plates 41 afforded by the supporting projections 15 provided on the inner surface of the detachable flange 10. As a result, the tension coil spring 70 connecting the connecting pins 62 and 63 contracts (shortens). Owing to contraction of the tension coil spring 70, the connecting plates 51, 52 tilt about the connecting pins 62, 64 (the inclination of the plates increases) and the split drum plates 41 move obliquely inward along the tapered faces 15*a* of the supporting projections 15 on the inner surface of the fixed flange 20. That is, the split drum plates 41 move radially in a direction that reduces the outer diameter thereof (inwardly, toward the center of the bobbin 1) and move toward the removed detachable flange 10 as well in comparison with FIGS. 2 and 5. The connecting plates 51, 52 become more inclined and the connecting pins 62 and 63 approach each other. Further, the gaps between the mutually adjacent split drum plates 41 become narrower. The tension coil spring 70 is provided in such a manner that the connecting plates 51, 52 will always tilt toward the detachable flange 10.

A stopper screw 71 the head of which points toward the inwardly projecting plate 42 is screwed into the outer surface of the outwardly projecting plate 31 (the surface facing the inwardly projecting plate 42) substantially at the center thereof. When the split drum plate 41 moves in the direction toward the center of the bobbin 1, the inwardly projecting plate 42 secured to the inner surface of the split drum plate 41 contacts the head of the stopper screw 71, thereby stopping the movement of the split drum plate 41. The traveling distance of the split drum plate 41 can be adjusted by adjusting the height of the stopper screw 71 (the amount by which the stopper screw 71 protrudes from the outer surface of the outwardly projecting plate 31).

For example, in comparison with diameter $D_1$ (see FIG. 2) of the winding drum 40 when the detachable flange 10 has been attached, diameter $D_2$ (see FIG. 5) of the winding drum 40 when the detachable flange 10 has been removed can be reduced on the order of 15 mm.

In a case where the detachable flange 10 once removed is re-attached, the inner surface of the detachable flange 10 is pushed against the side surface of the winding drum 40 (the six split drum plates 41). Owing to the fact that the tapered faces 40*a* of the winding drum 40 are pushed by the tapered faces 15*a* of the respective supporting projections 15 secured to the inner surface of the detachable flange 10, the winding drum 40 expands in the radial direction, moves toward the inner surface of the fixed flange 20 and is restored to its original position. The enlarged inclination of the connecting plates 51, 52 returns to the original inclination.

If the tapered faces 40*a* of the winding drum 40 (split drum plates 41) slide down completely from the respective tapered faces 15*a* of the supporting projections 15 secured to the inner surface of the fixed flange 20, it will be difficult, when the detachable flange 10 is re-attached, for the tapered faces 40*a* of the winding drum 40 to be placed upon the respective tapered faces 15*a* of the supporting projection 15 on the inner surface of the fixed flange 20. For this reason it is preferred that the size of the supporting projections 15 (tapered faces 15*a*) be decided in such a manner that, when the winding drum 40 (split drum plates 41) moves obliquely inward, a portion of each of the tapered faces 40*a* will continue to ride on (continue to remain in contact with) the respective tapered face 15*a* of each supporting projection 15 on the inner surface of the fixed flange 20.

Thus, when the detachable flange 10 is removed, the diameter of the winding drum 40 can be reduced with such removal of the flange. By winding the linear body on the winding drum 40 of diameter $D_1$, the linear body is brought together in the form of a cylinder having the diameter $D_1$ and the linear body is brought into strong contact with the winding drum 40. Nevertheless, the linear body can be pulled off the winding drum 40 easily while its cylindrical shape is maintained.

The linear body that has been pulled off the winding drum 40 of bobbin 1 is covered with vinyl or the like while its cylindrical shape is maintained and it is then transported by truck or the like. The bobbin 1, which has been used in order to bring the linear body together in the form of a cylinder, is not transported. Bobbinless transport for transporting a linear body alone without transporting the bobbin together with it is achieved in an effective manner.

At the destination of transport, the cylindrically shaped linear body is either mounted on a winding drum 40 of a bobbin 1 similar to that described above, or is mounted on the columnar shaft of a stand.

The invention claimed is:

1. A bobbin comprising:

a centrally provided hollow guide tube;

a pair of flanges provided on both ends of said hollow guide tube, said flanges each having a centrally provided shaft hole communicating with the hollow interior of said guide tube; and a winding drum, which is sandwiched between said pair of flanges, provided on the outer periphery of said guide tube;

wherein one flange of said pair of flanges is removably attached to one end of said guide tube and the other flange is fixedly secured to the other end of said guide tube;

said winding drum includes a plurality of split drum plates separated by a plurality of slits extending in a direction connecting said pair of flanges, a space being formed between an inner surface of each of the plurality of split drum plates and the outer surface of said guide tube;

a biasing mechanism for biasing each split drum plate obliquely inward is provided between the inner surface of each of the plurality of split drum plates and the outer surface of said guide tube; and both ends of each of the plurality of split drum plates are supported from the inner side thereof by respective supporting projections provided on the inner surface of each of said pair of flanges, wherein said biasing mechanism comprises:

a plurality of outwardly projecting plates (31) projecting outwardly from the outer surface of the guide tube (30);

a plurality of inwardly projecting plates (42) projecting inwardly from the inner surface of each of the plurality of split drum plates and facing each of the plurality of outwardly projecting plates (31);

a plurality of connecting pins (62), that are near the detachable flange (10), secured to each of the outwardly projecting plate (31) and extending in a direction connecting both side surfaces of the outwardly projecting plate (31);

a plurality of connecting pins (63), that are near the fixed flange (20), secured to each of the inwardly projecting plate (42) and extending in a direction connecting both side surfaces of the inwardly projecting plate (42); and tension coil springs (70), that are provided on each both side surfaces of a pair of inwardly and outwardly projecting plates (31, 42), and each obliquely connecting a connecting pin (62) that near the detachable flange (10) and a connecting pin (63) that near the fixed flange (20), when the detachable flange (10) has been removed from one end of said guide tube (30), by the biasing mechanism, the plurality of split drum plates (41) are moved obliquely in the direction of inward and facing the detachable flange (10) that has been removed.

2. A bobbin according to claim 1, wherein support faces of the supporting projections which support both ends of the split drum plates from the inner side thereof are inclined obliquely inward.

3. A bobbin according to claim 1, wherein the outer surface of said guide tube is provided with a plurality of stoppers for stopping, en route, obliquely inward movement of respective ones of the split drum plates.

4. A bobbin according to claim 3, wherein the outer surface of said guide tube is provided with a plurality of protruding members protruding outwardly, each stopper being secured to the outer surface of the respective protruding member in such a manner that the amount of protrusion of the stopper is adjustable.

5. A linear-body bobbinless transport method comprising:

preparing a bobbin according to claim 1;

winding the linear body on the winding drum in the expanded state to thereby bring the linear body together into a cylindrical shape;

removing the detachable flange from the one end of the guide tube;

retracting the winding drum radially inward by moving the winding drum obliquely in the direction of radially inward and facing the detachable flange that has been removed, using the biasing mechanism;

removing the cylindrically shaped linear body, which has been wound on the winding drum, from the winding drum in the retracted state with the linear body being maintained in cylindrical shape; and transporting the cylindrically shaped linear body that has been removed.

* * * * *